US009032873B2

(12) United States Patent
Dumenil

(10) Patent No.: US 9,032,873 B2
(45) Date of Patent: May 19, 2015

(54) SILK SCREEN PRINTING DEVICE WITH ONE MAIN ACTUATOR

(71) Applicant: François Dumenil, Chaumes en Brie (FR)

(72) Inventor: François Dumenil, Chaumes en Brie (FR)

(73) Assignee: MACHINES DUBUIT (FR)

( * ) Notice: Subject to any disclaimer, the term of this patent is extended or adjusted under 35 U.S.C. 154(b) by 56 days.

(21) Appl. No.: 14/048,633

(22) Filed: Oct. 8, 2013

(65) Prior Publication Data

US 2014/0109781 A1 Apr. 24, 2014

(30) Foreign Application Priority Data

Oct. 19, 2012 (FR) ..... 12 60006

(51) Int. Cl.

| | |
|---|---|
| ***B05C 17/04*** | (2006.01) |
| ***B41F 15/44*** | (2006.01) |
| ***B41F 15/08*** | (2006.01) |
| ***B41F 15/14*** | (2006.01) |
| ***B41F 15/18*** | (2006.01) |
| ***B41F 15/30*** | (2006.01) |
| ***B41F 15/36*** | (2006.01) |
| ***B41F 15/42*** | (2006.01) |

(52) U.S. Cl.

CPC ..... *B41F 15/44* (2013.01); *B41F 15/0872* (2013.01); *B41F 15/14* (2013.01); *B41F 15/18* (2013.01); *B41F 15/30* (2013.01); *B41F 15/36* (2013.01); *B41F 15/423* (2013.01)

(58) Field of Classification Search

CPC ..... B41F 15/085; B41F 15/16; B41F 15/18; B41F 15/30; B41F 15/34; B41F 15/42; B41F 15/00; B41F 15/423; B41F 15/36; B41F 15/44; B41F 15/0872; B41F 35/003; B41F 35/005; B41M 2205/14

USPC ..... 101/48, 123, 127.1

See application file for complete search history.

(56) References Cited

U.S. PATENT DOCUMENTS 3,249,044 A 5/1966 Karlyn
5,694,843 A * 12/1997 Chen ..... 101/123

(Continued)

FOREIGN PATENT DOCUMENTS

DE 299 13 104 U1 9/1999
GB 984 204 2/1965

OTHER PUBLICATIONS

French Search Report dated Aug. 16, 2013 issued in corresponding French patent application FR 12 60006.

*Primary Examiner* — Matthew G Marini
(74) *Attorney, Agent, or Firm* — Ostrolenk Faber LLP

(57) ABSTRACT

A device (1) for printing an impression by silk screen printing on at least one object (3), comprising of: a chassis (27); an object holder module (5) being movable relative to the chassis along a direction of pressing (Oz); a print head (7) including a screen holder module (29) and a squeegee holder module (31), the print head being movable relative to the chassis between an operating position close to the object holder module, and a maintenance position away from the object holder module, and an actuator (8) having a first part (125) and a second part (127) that is movable relative to the first part (125), the actuator (8) being adapted, in a first mode of operation, to be supported on the chassis by the first part and capable of moving the print head from the operating position to the maintenance position by a movement of the second part. The actuator is adapted, in a second mode of operation, to be supported on the chassis by the second part and is capable of moving the object holder module along the direction of pressing relative to the chassis by a movement of the first part.

11 Claims, 13 Drawing Sheets

(56) References Cited

U.S. PATENT DOCUMENTS 6,138,560 A 10/2000 Chen
6,202,551 B1 * 3/2001 Murakami ..... 101/123
7,047,879 B2 * 5/2006 Chen ..... 101/126
7,337,718 B2 * 3/2008 Chen ..... 101/126

* cited by examiner

SILK SCREEN PRINTING DEVICE WITH ONE MAIN ACTUATOR

TECHNICAL FIELD OF THE INVENTION

The present invention relates to a device for printing an impression by silk screen printing on at least one object, of the type comprising of:

a chassis an object holder module that is designed to hold the object, the object holder module being movable relative to the chassis along a direction of pressing, a print head including a screen holder module that is designed to hold a screen and a squeegee holder module that is designed to hold a squeegee (doctor blade) located facing the screen, the print head being movable relative to the chassis between an operating position close to the object holder module, and a maintenance position away from the object holder module, and an actuator comprising a first part and a second part that is movable relative to the first part, the actuator being adapted, in a first mode of operation, to be supported on the chassis by its first part and capable of moving the print head from the operating position to the maintenance position by a movement of the second part.

BACKGROUND OF THE INVENTION

It is known that the screen forms a stencil designed to be applied on to the object to be printed. The role of the squeegee is to force an ink applied on the screen to pass through the free meshes of the screen.

An actuator assembly makes it possible to obtain the movements of the print head and the object holder module in order to ensure the proper completion of the printing operations while the print head is in the operating position.

In order to change the screen, or indeed to clean it if, for example, there are dust particles obstructing one of the meshes, it is a known practice to lift the print head from the operating position to the maintenance position so as to allow easy access to the screen. This movement is performed outside of printing operations, and it is part of the maintenance of the device.

In order to obtain this lifting movement, it is a known technique to mount the print head on a parallelogram or on vertical guides actuated by a dedicated actuator, for example a pneumatic cylinder. The actuator is typically attached to the chassis by the first part, with the second part carrying the print head.

Moreover, for changing the elevation of the object holder module, it is a known technique for it to be actuated by means of a specific motor for example, a digitally controlled motor.

This therefore results in a printing device that is complex, and therefore expensive.

SUMMARY OF THE INVENTION

An object of the invention is thus to simplify the printing device, in order to reduce the cost thereof, while preserving its comparable functionalities.

To this end, the invention relates to a device for printing an impression by silk screen printing on at least one object, of the type described here above, wherein the actuator is adapted, in a second mode of operation, to be supported on the chassis by the second part and is capable of moving the object holder module along the direction of pressing relative to the chassis by a movement of the first part.

According to particular embodiments, the device includes one or more of the following characteristic features, considered in isolation or in accordance with all technically possible combinations:

in the first mode of operation, the first part of the actuator is supported on an end stop of the chassis;

the device comprises a fastening system designed, selectively, for fastening the screen holder module on to the chassis in a manner such that the print head forms a support for the second part of the actuator, and for releasing the screen holder module so as to enable the said movement of the print head from the operating position to the maintenance position;

the fastening system is adjustable along the direction of pressing for selectively fastening the screen holder module on to the chassis in a plurality of positions along the direction of pressing defining a plurality of operating positions for use of the print head, the actuator being capable, in the first mode of operation, of moving the print head from any one of the operating positions from among said plurality of operating positions to any other operating position from among said plurality of positions when the screen holder module is released relative to the chassis;

the fastening system comprises a rack fastened on to one of either the screen holder module and the chassis, and a latch fastened on to the other of the screen holder module and the chassis, the latch being movable selectively between a closed position wherein the latch engages on to the rack so as to lock in the screen holder module relative to the chassis along the direction of pressing and an open position for releasing the screen holder module, the screen holder module is mounted so as to be movable relative to the squeegee holder module along the direction of pressing, and the screen holder module comprises an indexing member and the squeegee holder module comprises a complementary indexing member, the indexing member of the screen holder module being capable of cooperating with the complementary indexing member in order to define a relative position of use of the squeegee holder module relative to the screen holder module intended to enable contact between the squeegee and the screen, and wherein the indexing member forms a bottom end stop for the complementary indexing member, and a position for differential lifting of the squeegee holder module relative to the screen holder module designed to move the squeegee away from the screen, and wherein the complementary indexing member forms a bottom end stop for the indexing member;

the indexing member comprises a base, a rod extending along the direction of pressing, and a head that is wider than the rod, and the complementary indexing member defines a housing extending along the direction of pressing and adapted to receive the head, the housing having a narrowed opening around the rod so as to trap the head, the head being adapted to abut against the opening of the housing, and the opening of housing being adapted to abut against the base, the indexing member and the complementary indexing member are suitably dimensioned such that in the position of differential lifting, in relation to the relative position of use, the squeegee holder module is positioned at a distance from the screen holder module at a height of between 15 mm and 60 mm, preferably equal to about 30 mm, the actuator comprises a threaded shaft, a ball nut mounted so as to be movable only in translational motion on the shaft, and a motor for driving the shaft in axial rotation;

the ball nut is located in the first part of the actuator, and the motor is located in the second part, the device comprises a pressure sensor adapted to be compressed between the chassis and the first part of the actuator in order to measure the forces transmitted to the chassis by the first part of the actuator.

BRIEF DESCRIPTION OF THE DRAWINGS

The invention will be better understood upon reading the description which follows, given by way of example, and with reference made to the accompanying drawings, in which.

DESCRIPTION OF EMBODIMENTS

Figure 1:
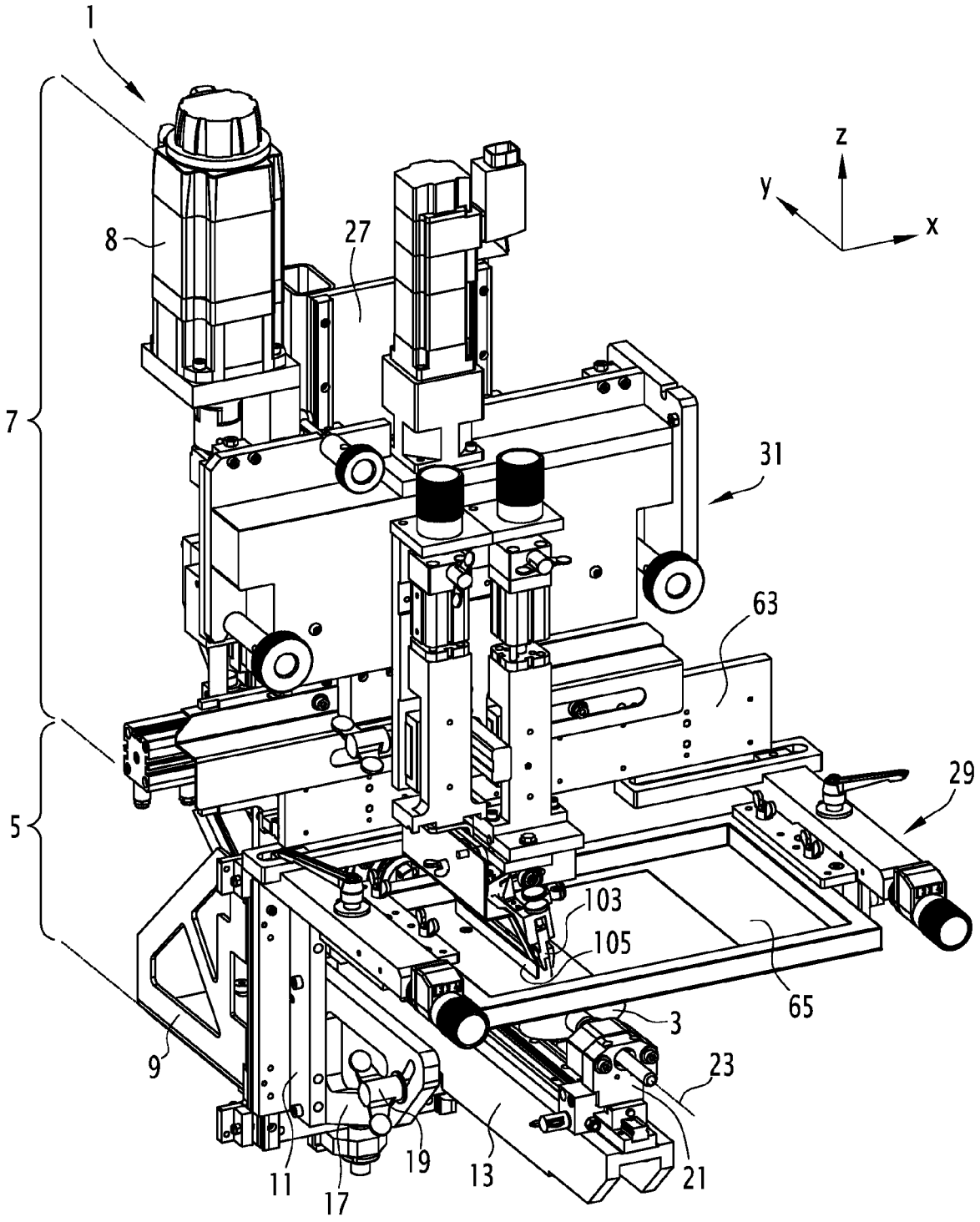
FIG. 1 is a perspective view of a device according to the invention, according to a viewing angle of about 30° relative to a front view, the actuator being in the second mode of operation, the print head being in the operating position.

With reference to FIGS. 1 to 4, the illustrations describe a device 1 according to the invention for printing an impression by silk screen printing on an object 3.

The term "is (to be) supported on the chassis" with respect to the first part of the actuator as well as to the second part, is understood to refer to the fact that the part in question, either directly or indirectly, supports itself on the frame. Direct support of the part in question is evident for example in the act of its resting on the chassis or being secured on to the chassis. Indirect support is evident for example in the act of its resting or being secured, on to an element that is itself resting on, or is secured on to the chassis.

The object 3 is for example a glass vial, of a generally cylindrical shape. In a variant (not shown), the object 3 has a shape that is generally conical, oval, or even multi-faceted.

The device 1 extends along a direction of pressing Oz, for example, that is substantially vertical. Furthermore two directions are also defined, Ox, Oy which are horizontal and perpendicular to each other, the reference Ox, Oy, Oz being direct.

The object 3 extends mainly, in the example shown, along the direction Oy.

The device 1 includes an object holder module 5 which is located at the bottom of the device 1 and holding the object 3, a print head 7 located above the object holder module 5, and an actuator 8 for lifting the print head 7 and the object holder module 5.

Figure 2:
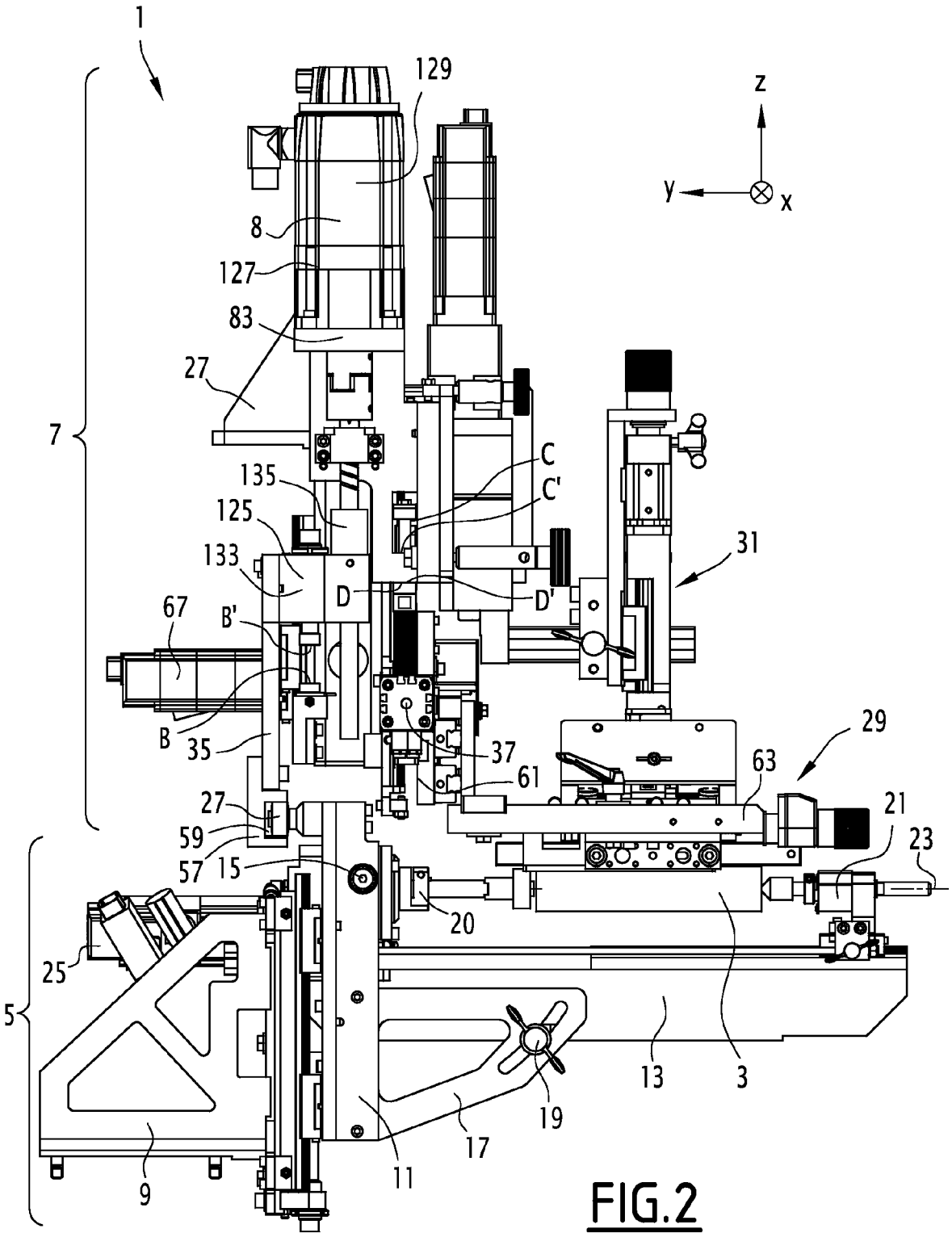
FIG. 2 is a view from the left of the device represented in FIG. 1, FIGS. 3 and 4 are kinematic diagrams of the device represented in FIGS. 1 and 2, respectively illustrating the first mode of operation and the second mode of operation of the actuator.

As shown in the FIG. 2, the object holder module 5 includes a frame 9, a carriage 11 mounted so as to be movable relative to the frame 9 along the direction of pressing Oz, an arm 13 mounted so as to be pivotable on the carriage 11 about an axis 15 oriented substantially along the direction of printing Ox.

The object holder module 5 further comprises the means 17, 19 for adjusting the angle made by the arm 13 relative to the frame 9 about the axis 15. The tilt adjustment allows printing, for example, on an object 3 having a conical shape.

The object holder module 5 is movable along the direction of pressing Oz relative to the print head 7 because of the mobility of the carriage 11 relative to the frame 9.

The arm 13 is, in the example shown, substantially horizontal and thus extends substantially in the direction Oy.

The arm 13 comprises the members 20, 21 for holding the object 3.

The members 20, 21 may be adapted to the dimensions of the object 3. The members 20, 21 are mounted so as to be rotatable about an axis 23 connected to the arm 13. The members 20, 21 are driven in rotation, for example, by an actuator 25 integrally attached to the arm 13.

The axis 23 extends substantially along the direction Oy in the example shown.

The carriage 11 includes a roller 27 for controlling the elevation of the arm 13 relative to the frame 9.

The roller 27 protrudes from the carriage 11 substantially along the direction Oy The roller 27 is for example located substantially at the top of the carriage 11.

According to the techniques and methods known per se, the frame 9 of the object holder module 5 is advantageously mounted on a turn table (not shown) that includes other object holder modules similar to the object holder module 5 for holding other objects. The turn table unit is for example of the "carousel" type, that is to say mounted to be rotatable about a substantially vertical axis, or of the "revolving" type, that is to say mounted to be rotatable about a substantially horizontal axis, for example substantially parallel to the direction Oy.

With reference to FIGS. 1 and 2, the print head 7 comprises a chassis 27, a screen holder module 29 and a squeegee holder module 31 mounted so as to be movable independently of one another in a substantially vertical translational motion on the chassis 27, and a movable carriage 35 vertically extending between the actuator 8 and the object holder module 5.

The print head 7 also comprises a fastening system 37 for fastening the screen holder module 29 on to the chassis 27, in multiple parts shown more particularly in FIGS. 2 to 6, and 9 to 11.

Figure 3:
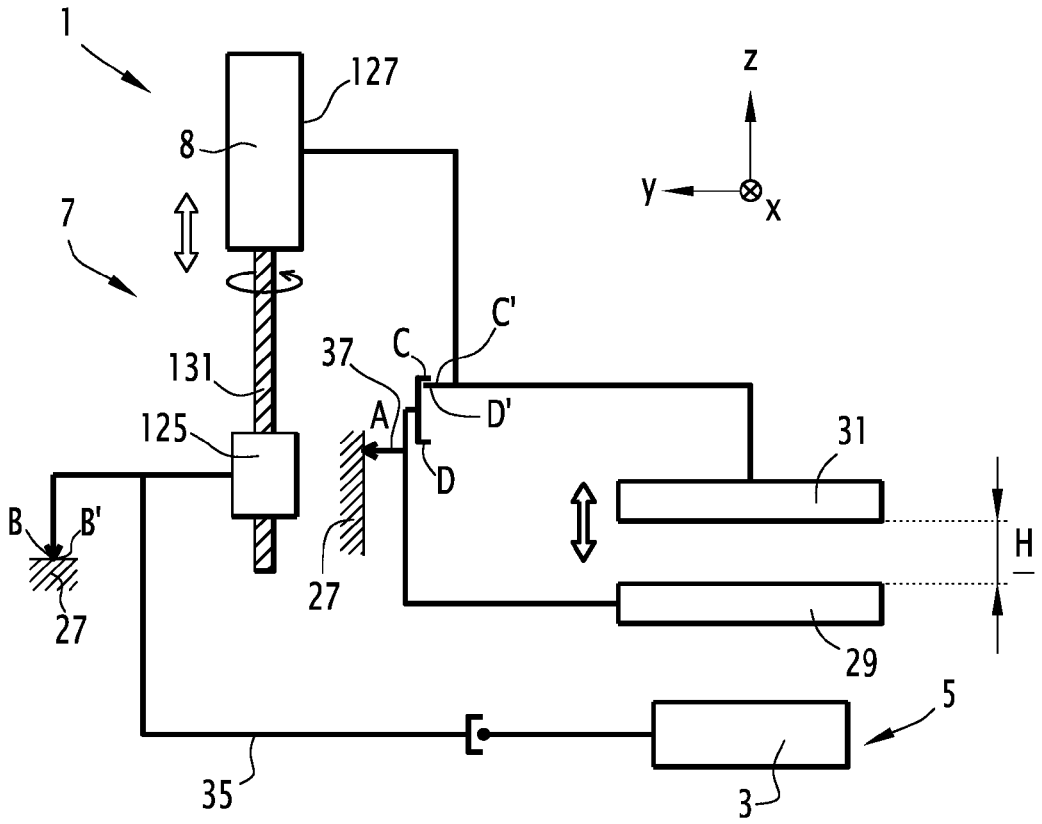
Figure 17:
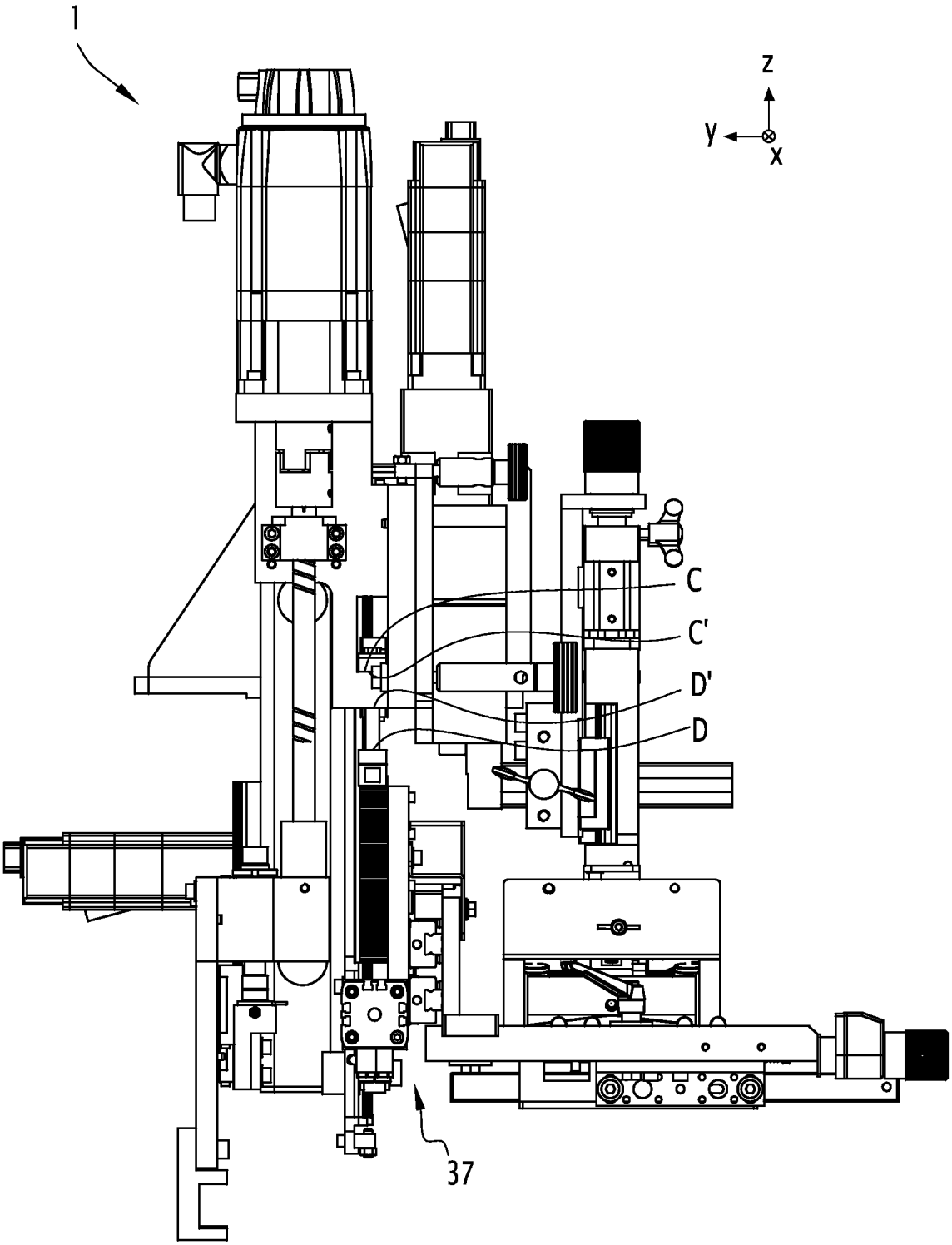
FIG. 17 is a view from the left, without the object holder module, of the device represented in FIGS. 1, 2, 15 and 16, wherein the actuator is in the first mode of operation, with the print head being in the maintenance position.

The print head 7 is movable between an operating position represented in FIGS. 1, 2, 4 and 15 wherein the print head 7 is close to the object holder module 5, and a maintenance position shown in FIGS. 3 and 17, wherein the print head 7 is positioned at a distance from the object holder module 5.

The chassis 27 (FIGS. 5 and 6) comprises vertical rails 38, 39 for mounting of the screen holder module 29 and the squeegee holder module 31, rails 41, 43 for mounting of the movable carriage 35, a support 45 for a part of the fastening system 37, and a tab 47 having a top surface forming an end stop B. The chassis 27 advantageously defines an opening 49 that allows the through passage of a portion of the screen holder module 29 along the direction Oy, as will be explained here below.

The opening 49 extends for example, substantially parallel to the plane Ox, Oz.

Figure 8:
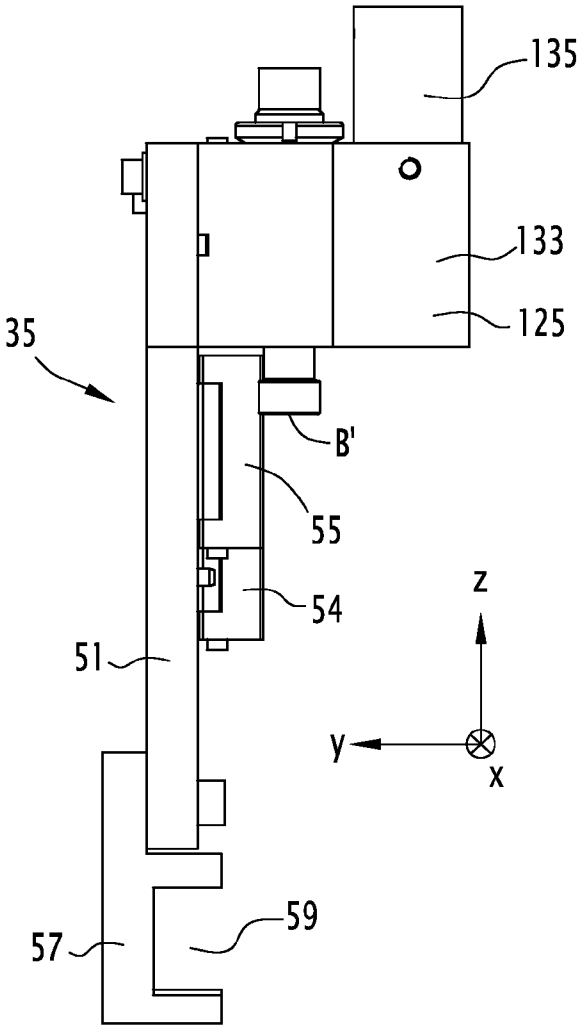
Figure 7:
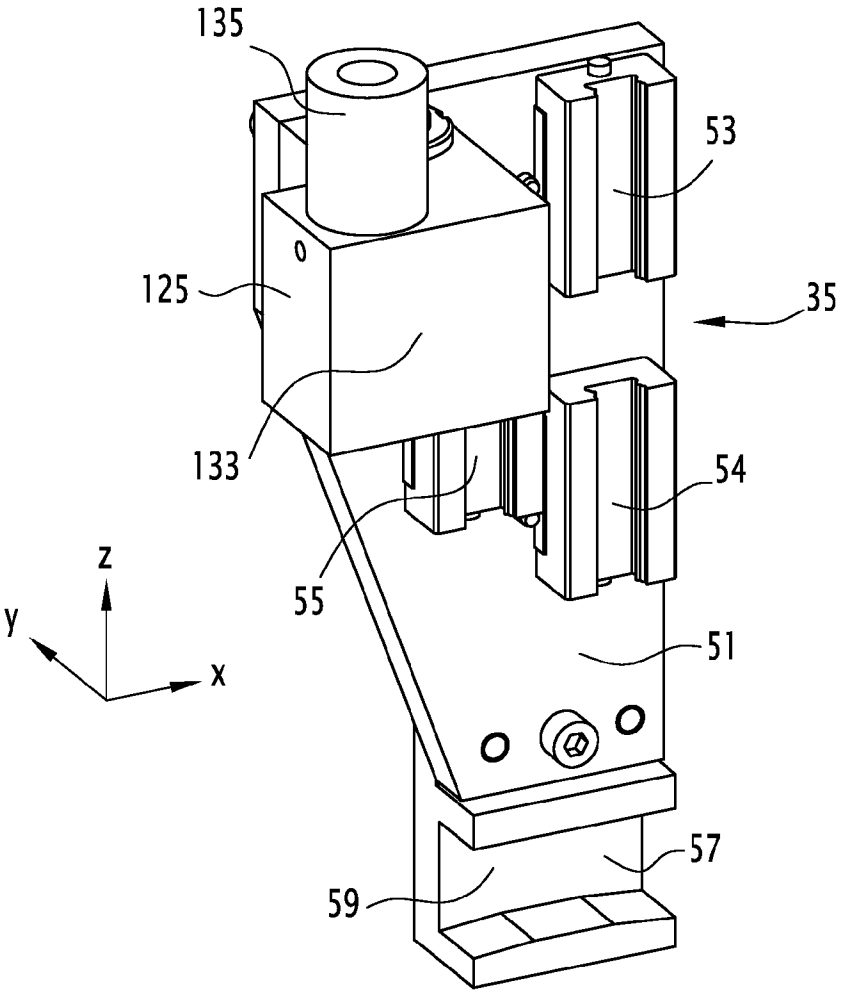
Figure 10:
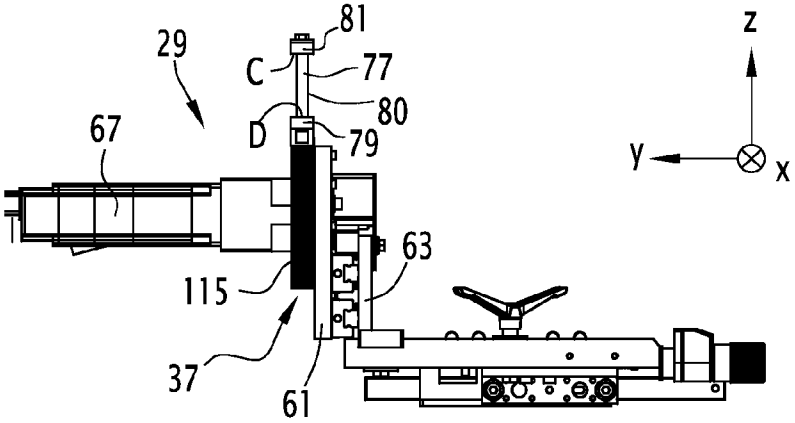
Figure 11:
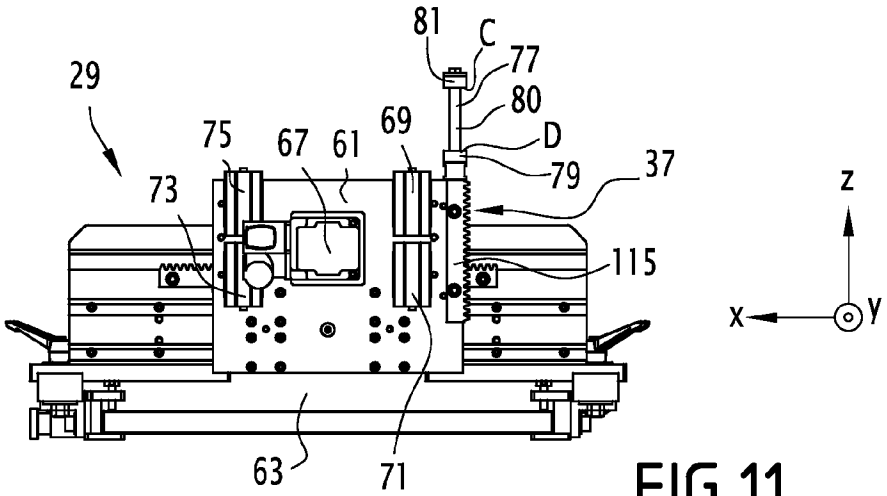
Figure 9:
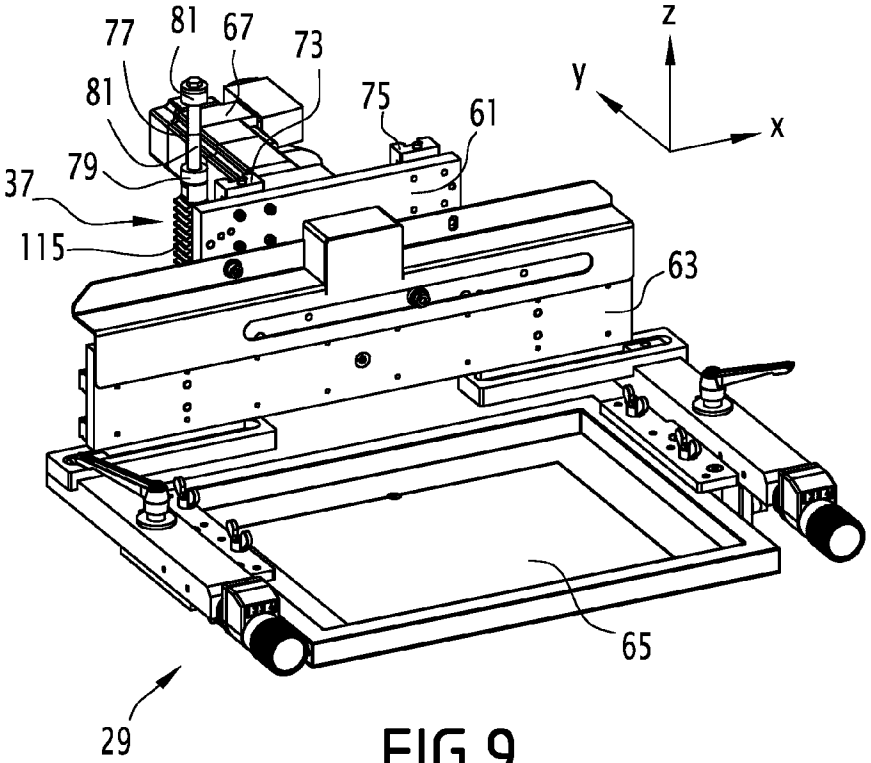

The movable carriage 35 (FIGS. 7 and 8) comprises a plate 51, with slides 53, 54, 55 fixed on to the plate 51 and mounted so as to be movable on the rails 41, 43 of the chassis 27 (FIG. 5), and a yoke 57 fixed to the plate 51 and defining a cam channel 59 capable of cooperating with the roller 27 of the object holder module 5 (FIG. 2).

Figure 5:
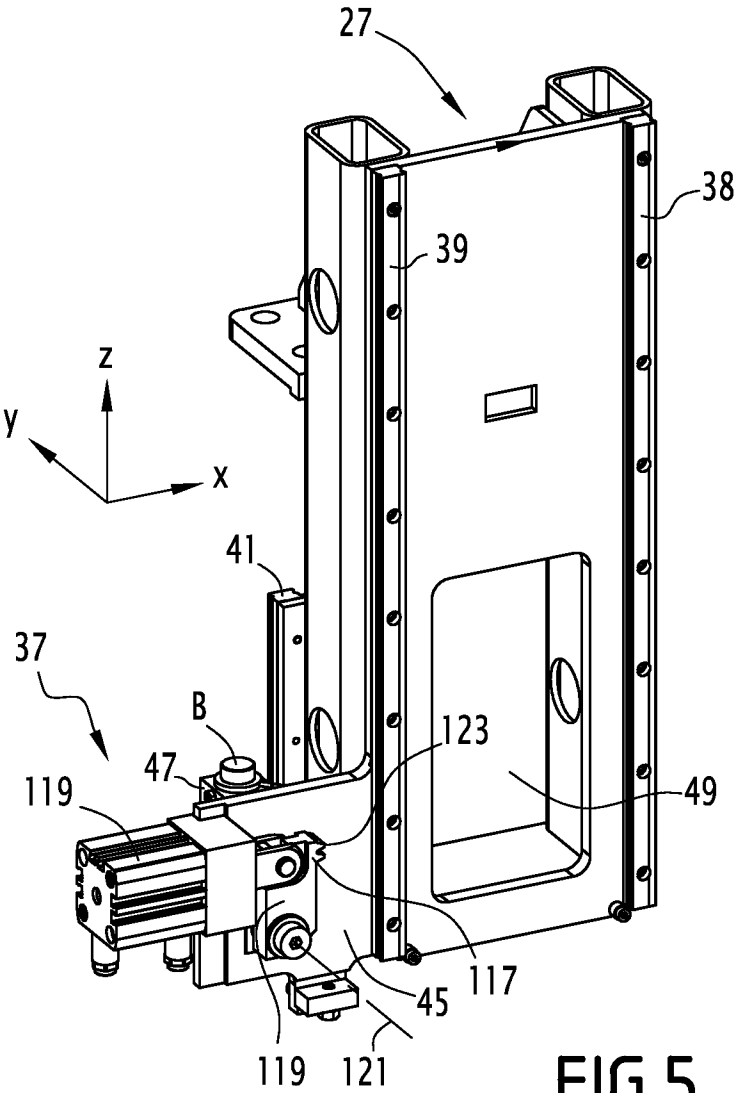

The screen holder module 29 (FIGS. 9, 10 and 11) comprises a support 61, an adjustable screen holder 63, a screen 65 held by the screen holder 63, an actuator 67, and the slider 69, 71, 73, 75 fixed on to the support 61 and mounted so as to be movable on the rails 38, 39 of the chassis 27 (FIG. 5).

The screen holder module 29 further includes an indexing member 77 (FIGS. 9, 10 and 11) for indexing the position of the screen holder module 29 relative to the squeegee holder module 31 along the direction of pressing Oz.

The position of the support 61 (FIGS. 2 and 10) relative to the chassis 27 defines for example the position along the direction of pressing (Oz) of the screen holder module 29.

The adjustable screen holder module 63 is mounted so as to be movable, in substantially translational motion along the direction of printing Ox on the support 61.

The actuator 67 extends into the opening 49 of the chassis 27 (FIG. 5) substantially along the Oy direction. The actuator 67 is capable of moving the screen holder module 63 relative to the frame 61 along the direction of printing Ox.

The indexing member 77 includes a base 79 fastened on to the support 61, a rod 80 projecting out from the base 79 substantially vertically and towards the top, and a head 81 located at the end of the rod 80 and advantageously wider than the rod 80.

The head 81 of the indexing member 77 defines by means of a bottom surface, an end stop C (FIGS. 10 and 11) for stopping the screen holder module 29 towards the object holder module 5 in the direction of pressing Oz.

The base 79 of the indexing member 77 defines by means of a top surface, an end stop D (FIGS. 10 and 11) for stopping the screen holder module 29 towards the squeegee holder module 31 in the direction of pressing Oz.

The screen 65 is advantageously rectangular. For example, the sides of the screen are substantially parallel respectively in directions Ox and Oy.

Figure 12:
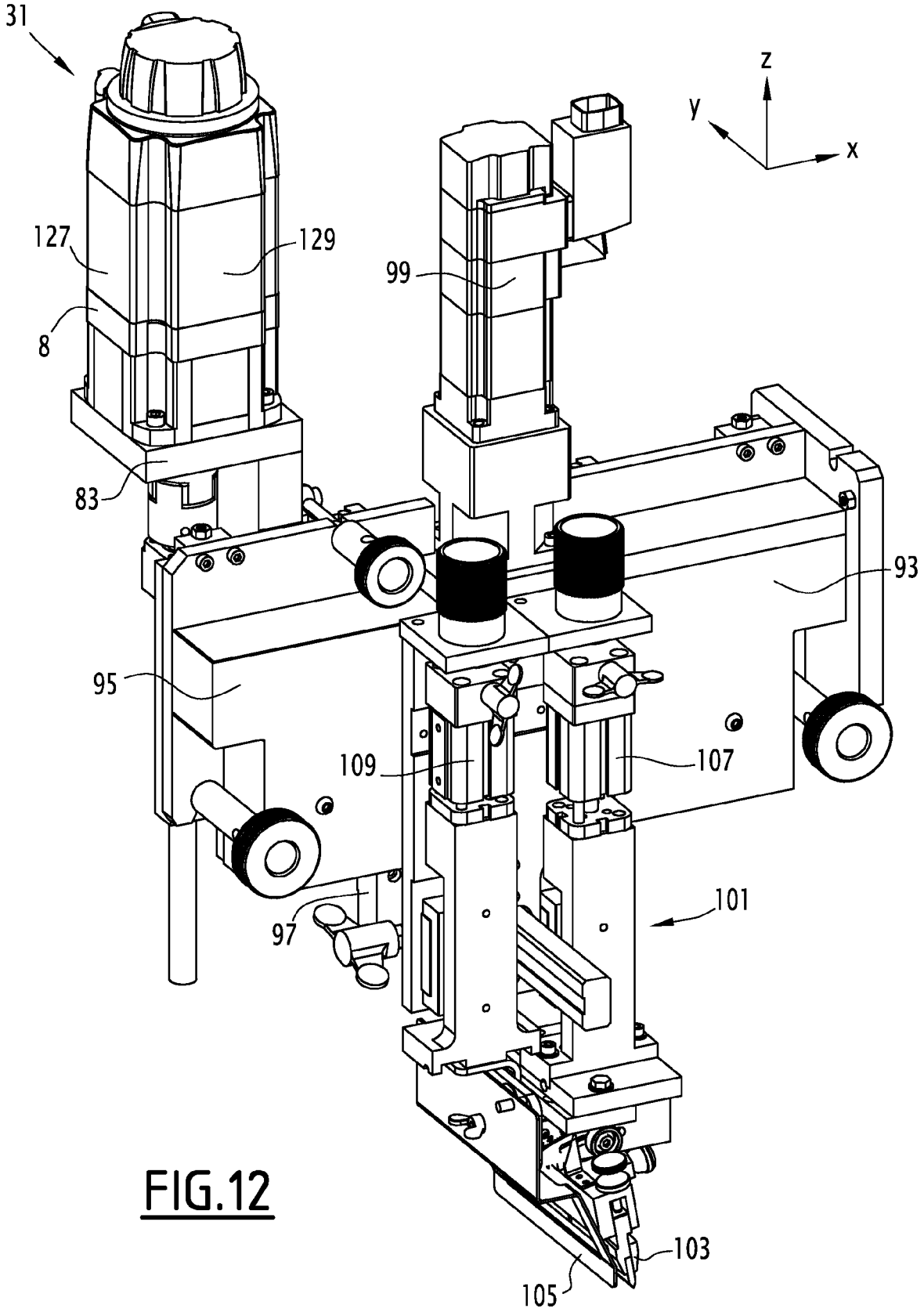
Figure 13:
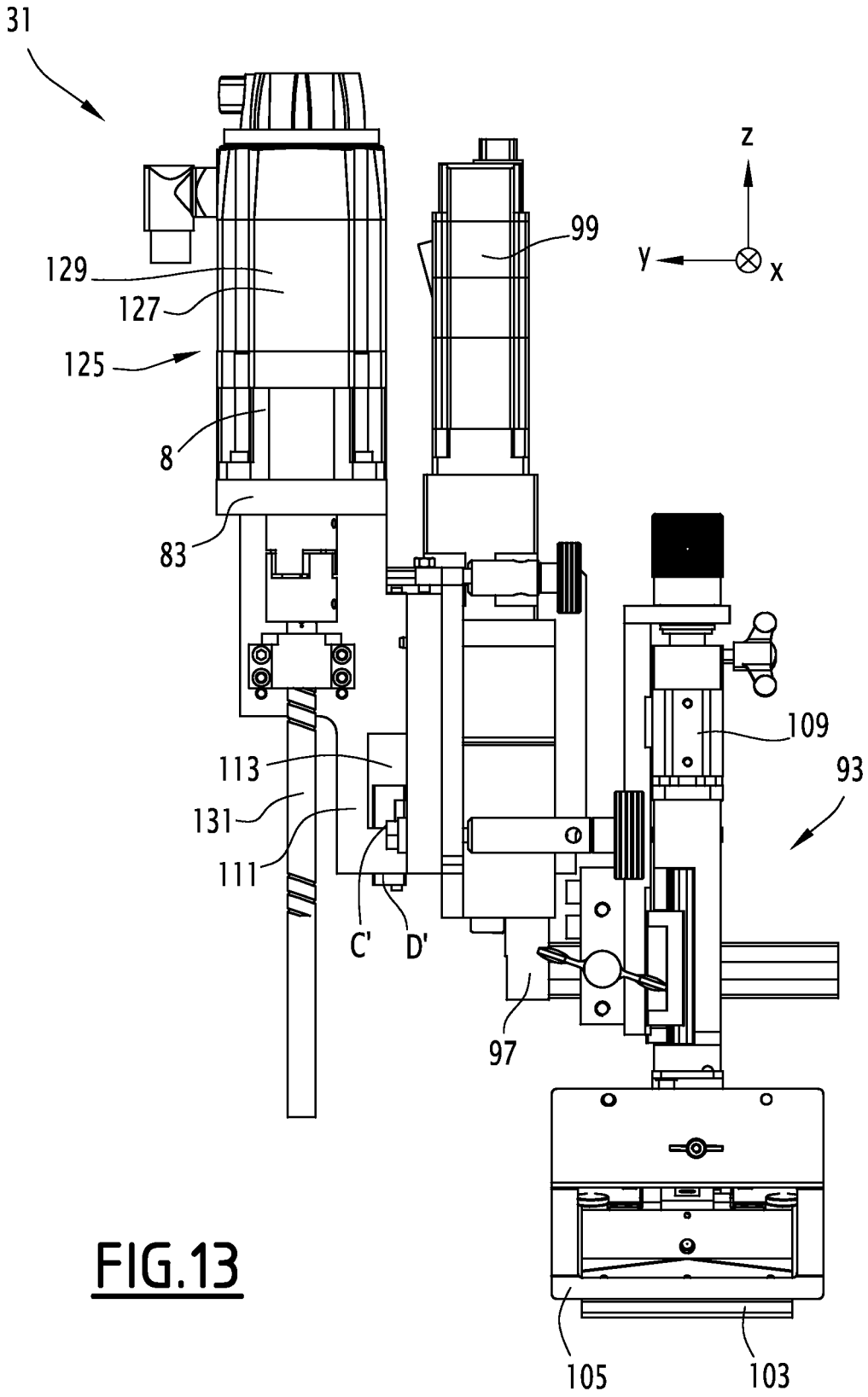
Figure 14:
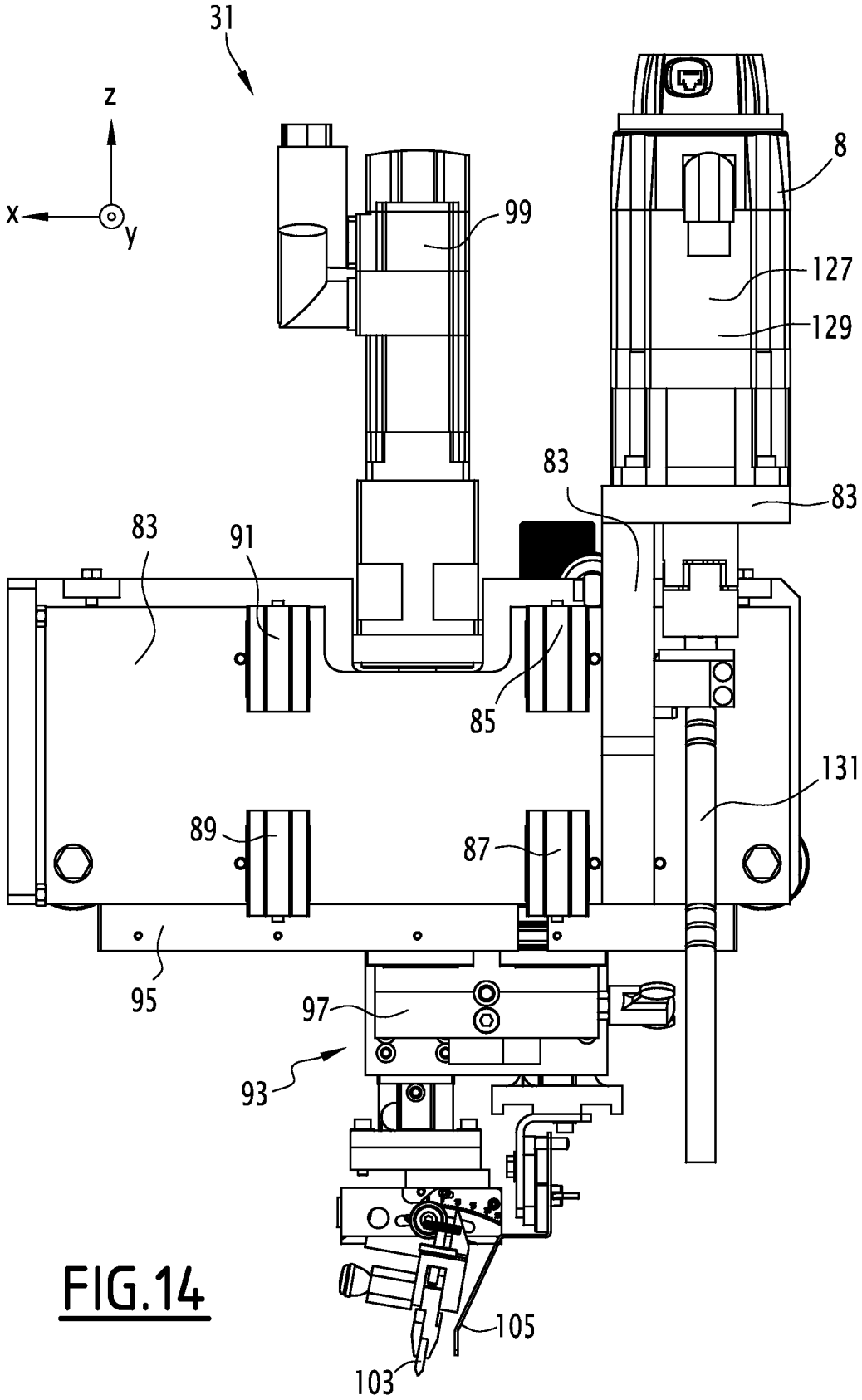

As shown in FIGS. 12, 13 and 14, the squeegee holder module 31 includes a support 83, the slides 85, 87, 89, 91 fastened on to the support 83 and mounted so as to be movable on the rails 38, 39 of the chassis 27 (FIG. 5), and a squeegee holder 93 fastened on to the support 83.

Figure 15:
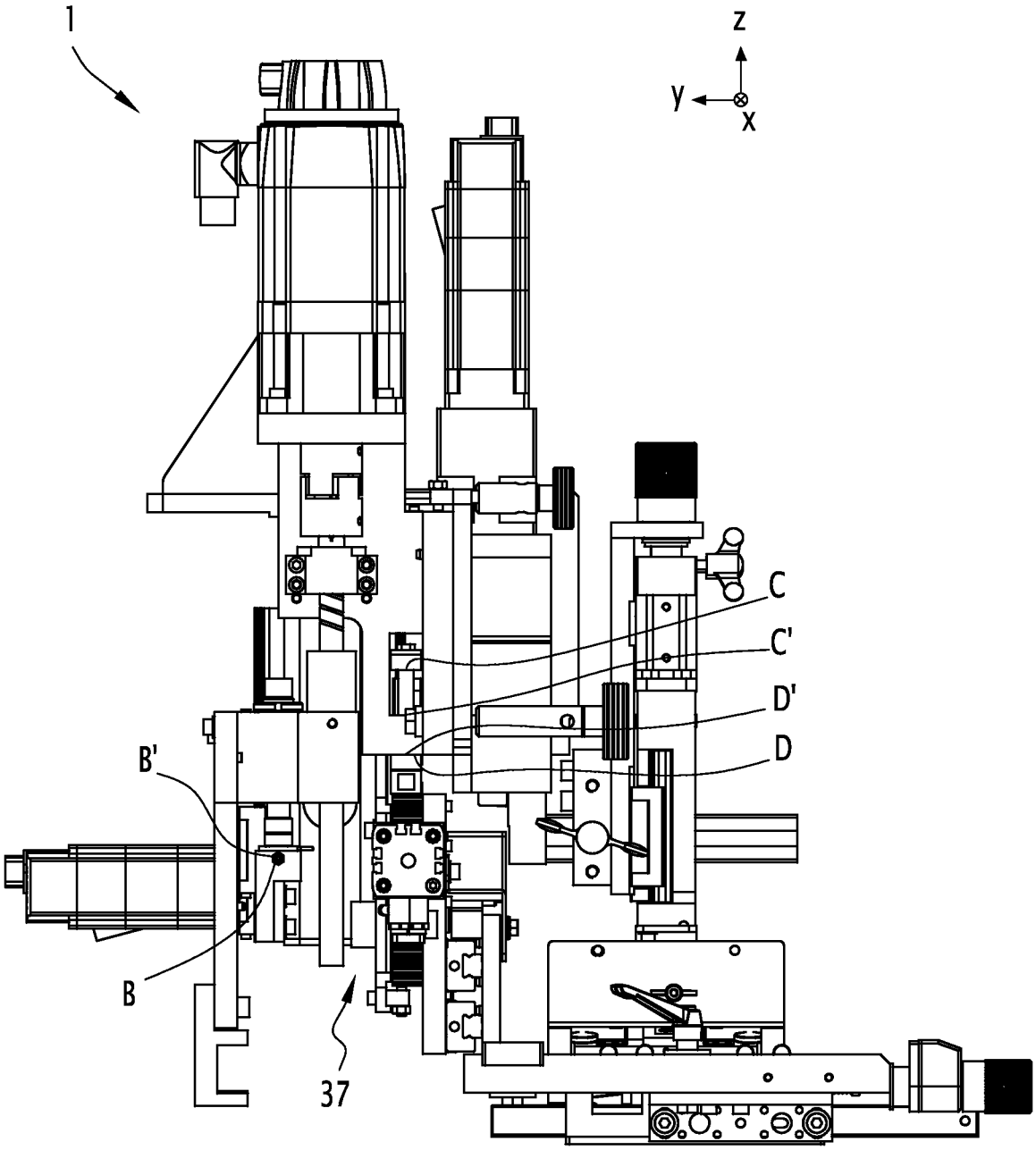
FIG. 15 is a view from the left, without the object holder module, of the device represented in FIGS. 1 and 2, the print head being in the operating position, the actuator being in the first mode of operation.
Figure 16:
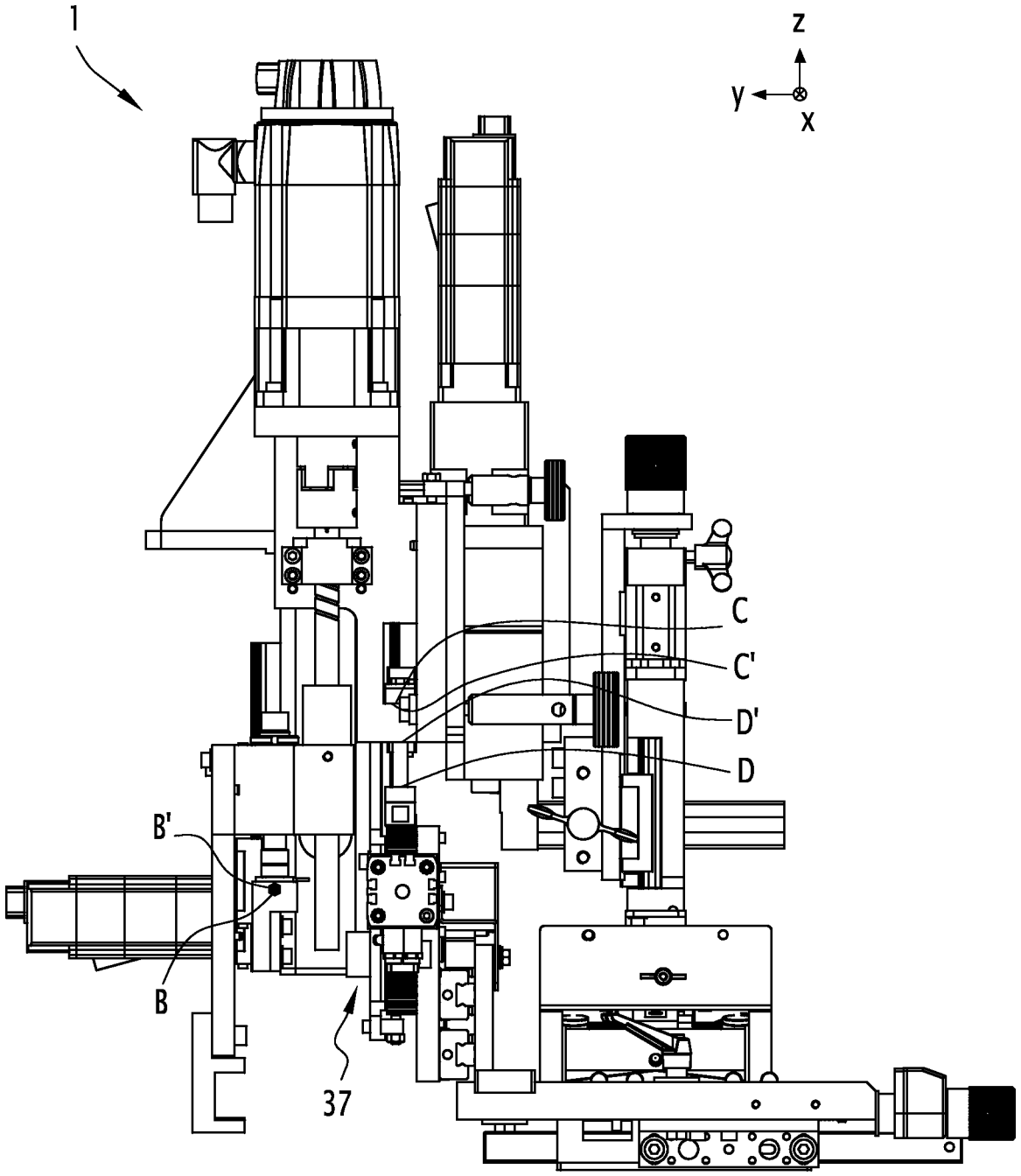
FIG. 16 is a view from the left, without the object holder module, of the device represented in FIGS. 1, 2 and 15, wherein the actuator is in the first mode of operation, with the squeegee holder module being in the position of differential lifting.

The squeegee holder module 31 is movable relative to the screen holder module 29 along the direction of pressing Oz between a relative position of use visible in FIGS. 1, 2, 4, and 15, wherein the squeegee holder module 31 is close to the screen holder module 29, and a position of differential lifting shown in FIGS. 3, 16 and 17, wherein the squeegee holder module 31 is positioned at a distance from the screen holder module is 29.

According to a particular embodiment, in the position of differential lifting, the squeegee holder module 31 is positioned at a distance from the screen holder module 29, as compared to the relative position of use, at a height H of between 15 mm and 60 mm, advantageously equal to about 30 mm.

Figure 18:
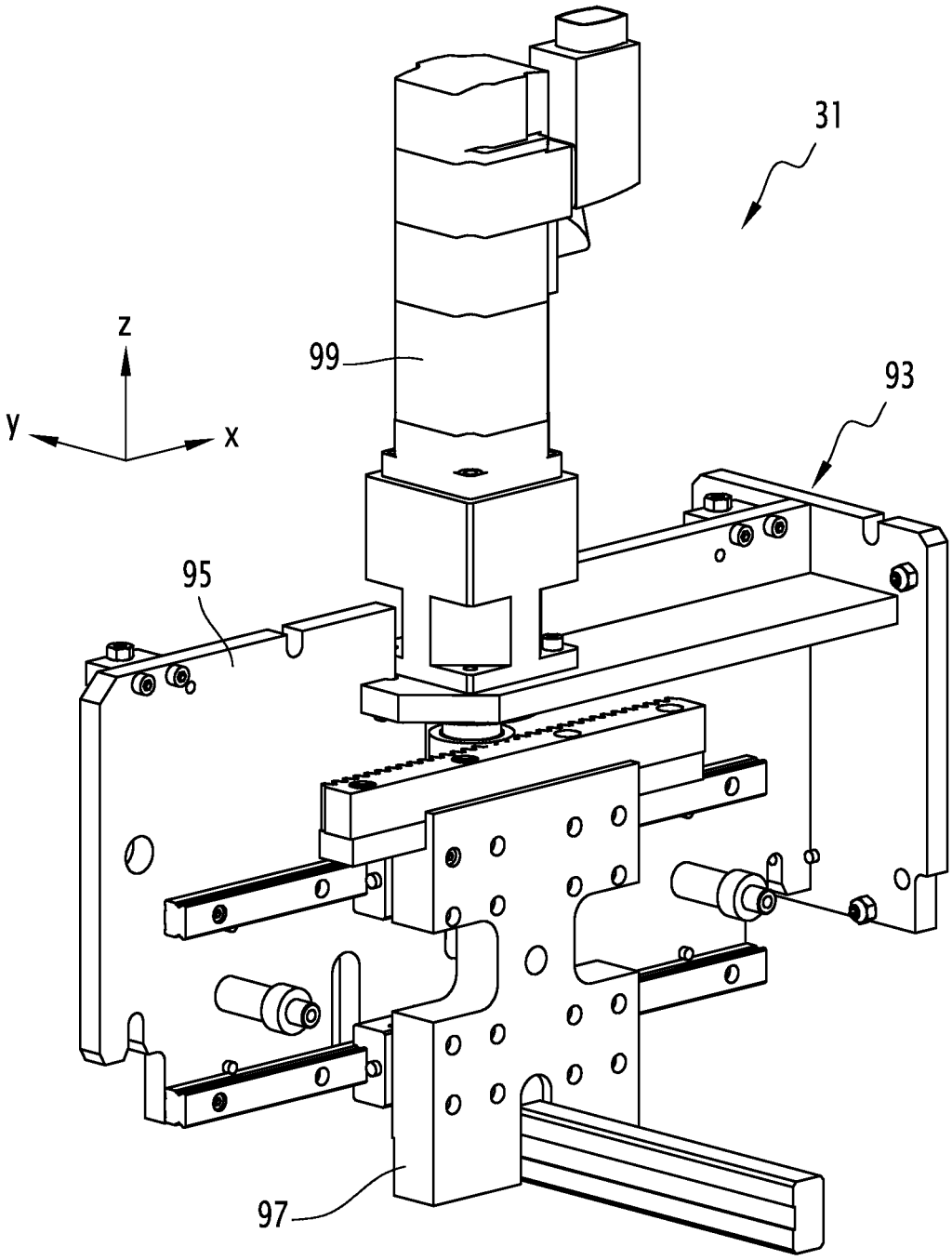
FIG. 18 is a perspective view of a part of the squeegee holder module.

The squeegee holder module 93, visible in FIGS. 12 and 18, comprises a frame 95 mounted on the support 83, a carriage 97 mounted so as to be movable on the frame 95 in translational motion substantially along the direction of printing Ox relative to the frame 95 (FIG. 18), an actuator 99 for moving the carriage 97 in translational motion substantially along the direction of printing Ox, and a squeegee holder assembly 101 fastened on to the carriage 97.

The squeegee holder assembly 101 includes a squeegee (squeegee) 103, a counter squeegee 105 designed to bring back the ink by sweeping over the screen 65, an actuator 107 for lowering and raising the squeegee 103 respectively towards and away from the screen 65, and an actuator 109 for lowering and raising the counter squeegee 105 respectively towards and away from the screen 65.

The actuators 107, 109 are, for example pneumatic cylinders.

The position of the support 83 (FIGS. 2 and 13) relative to the chassis 27 defines for example the position of the squeegee holder module 31 relative to the chassis 27 along the direction of pressing Oz.

The support 83 comprises a complementary indexing member 111 (FIG. 13) for indexing the position of the screen holder module 29 relative to the squeegee holder module 31 along the direction of pressing Oz. The complementary indexing member 111 is adapted to cooperate with the indexing member 77 of the screen holder module 29 in order to limit the relative movements of the screen holder module 29 relative to the squeegee holder module 31 along the direction of pressing Oz.

The complementary indexing member 111 has a lower surface defining a bottom end stop D' (FIG. 13) intended to cooperate with the end stop D of the indexing member 77 (FIGS. 2 and 15). The indexing member 111 further defines a housing 113 adapted to vertically hold the head 81 of the indexing member 77, for example by locking the head 81.

The housing 113 has a bottom surface forming an upper end stop C' adapted to cooperate with the end stop C of the indexing member 77.

The end stop C' is in contact with the end stop C of the indexing member 77 when the squeegee holder module 31 is in the position of differential lifting (FIGS. 3, 16 and 17).

The end stop D' is in contact with the end stop D of the indexing member 77 when the squeegee holder module 31 is in the relative position of use (FIGS. 1, 2, 4 and 15).

The fastening system 37 comprises a rack 115 fastened substantially vertically on to the support 61 of the screen holder module 29 (FIGS. 9 to 11), a latch 117 (FIG. 5) fastened on to the support 45 of the chassis 27 and mounted so as to be movable between a closed position, wherein it engages on to the rack 115, and an open position (not shown), wherein the latch 117 is moved away from the rack 115, and an actuator 119 for moving the latch 117.

According to another embodiment (not shown), the rack 115 is fastened on to the chassis 27 and the latch 117 is fastened on to the screen holder module 29.

According to other embodiments (not shown), the rack 115 is replaced by a track and the latch 117 by a brake designed for cooperating with the track.

In the example shown, the latch 117 includes a finger 119 mounted so as to be movable on the support 45 in rotation about an axis 121, and at least one tooth 123 at a distal end of the finger 119, on the side of the rack 115.

The latch defines a point of attachment A of the screen holder module 29 on the chassis 27. The point of attachment A is advantageously adjustable along the direction of pressing Oz relative to the chassis 27, defining a plurality of operating positions for use of the print head 7. Each operating position corresponds to a position of the screen holder module 29 along the direction of pressing Oz relative to the chassis 27.

The finger 119 extends substantially vertically upwards in the closed position of the latch 117.

The axis 121 is for example substantially parallel to the direction Oy,

The actuator 8 comprises a first part 125 (FIGS. 2 and 8) attached to the movable carriage 35, and a second part 127 (FIGS. 2 and 13) attached to the print head 7.

The second part 127 includes a motor 129 attached on to the support 83 of the squeegee holder module 31, and a threaded shaft 131 that extends for example substantially vertically and is driven to rotate by the motor 129.

The first part 125 comprises a base 133 fixed on to the carriage 35 that is movable only in translational motion along the direction of the shaft 131, and a ball nut 135 fixed in rotation and in translational motion on the base 133 and in which the shaft 131 is screwed.

The nut 135 is movable in translational motion along the shaft 131 by screwing and unscrewing the shaft 131.

The base 133 has a bottom surface defining an end stop B' adapted for cooperating with the end stop B of the chassis 27 (FIGS. 3, 8, 16 and 17).

Advantageously, a force sensor 137 (FIG. 6) is located on the end stop B or on the end stop B' in order to measure the forces transmitted between the end stops B and B'.

The operation of the device 1 will now be described.

Figure 4:
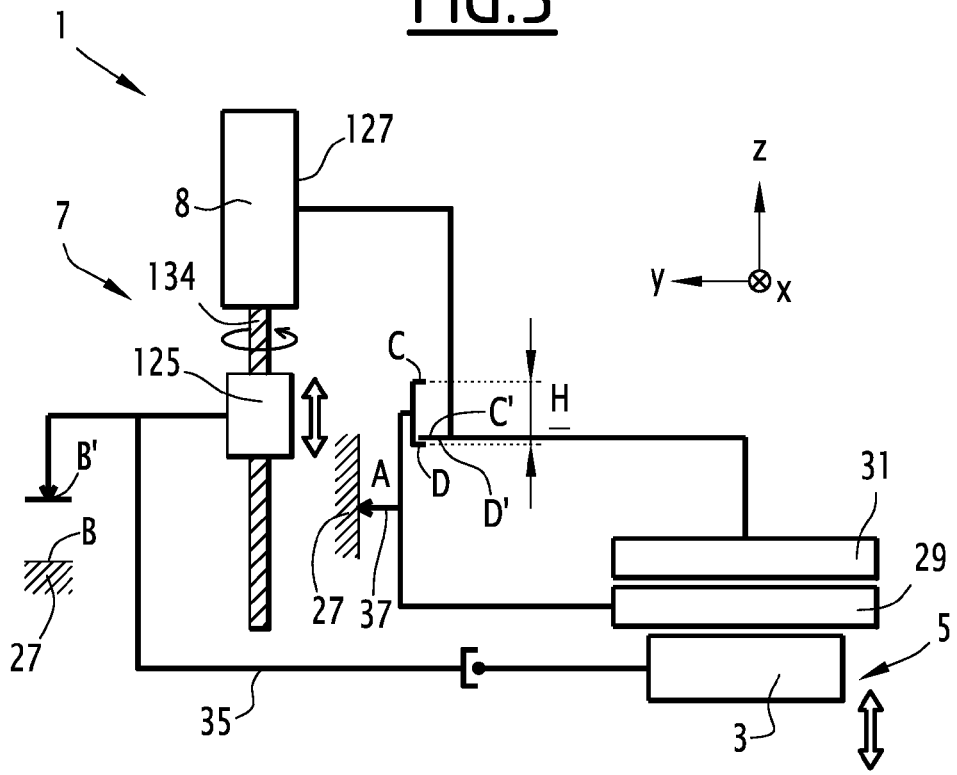
Figure 6:
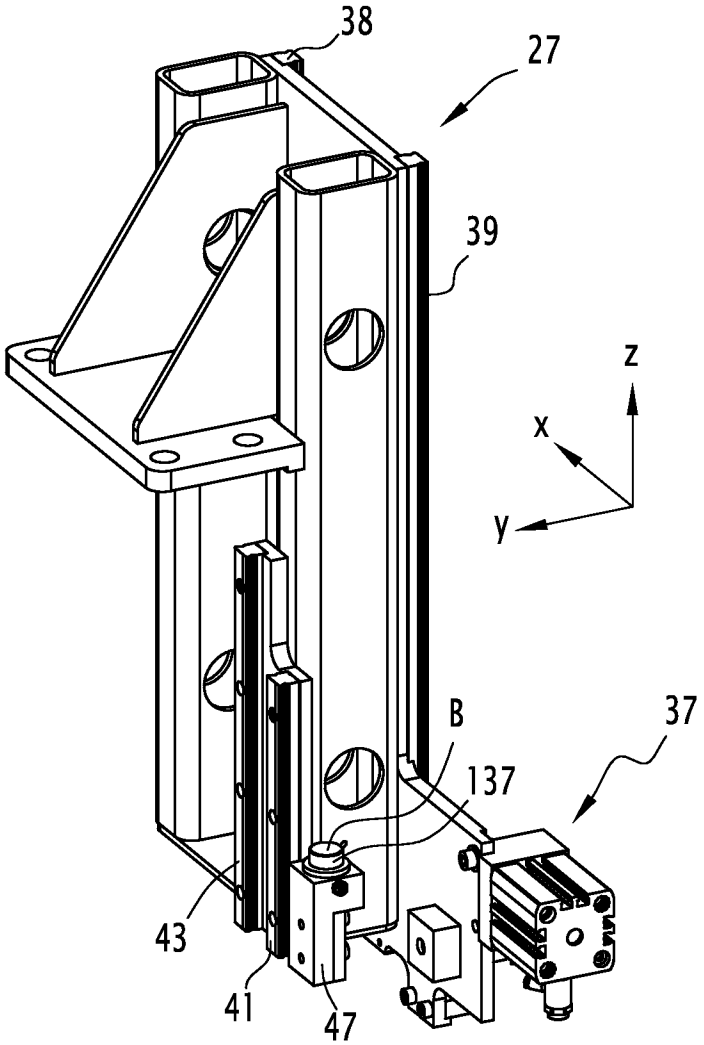
FIGS. 5 and 6 are two perspective views of the chassis of the device represented in FIGS. 1 and 2, FIGS. 7 and 8 are respectively a perspective view and a view from the left of a portion of the actuator and a movable carriage of the device represented in FIGS. 1 and 2, FIGS. 9, 10 and 11 are respectively a perspective view, a view from the left and a rear view of the screen holder module of the device represented in FIGS. 1 and 2, FIGS. 12, 13 and 14 are respectively a perspective view, a view from the left and a rear view of the squeegee (squeegee) holder module of the device represented in FIGS. 1 and 2 and of a part of the actuator, complementary to the part shown in FIGS. 7 and 8.

When the device 1 prints an impression on the object 3, the print head 7 is in the operating position shown in FIGS. 1, 2 and 4. The screen holder module 29 is thus immobilised relative to the chassis 27 by the fastening system 37. The tooth 123 engages with the rack 115 at point A, thereby ensuring the immobilisation.

The position of point A determines the position of the screen holder module 29 relative to the chassis 27 along the direction of pressing Oz, with an elevation of screen 65 corresponding thereto. The actuator 67 controls the position of the screen holder module 63 and the screen 35 along the direction of printing Ox.

The squeegee holder module 31 is in the relative position of use thus enabling the use of the squeegee 103 and the counter squeegee 105 on the screen 65 in accordance with the methods and techniques known per se in order to print an impression by silk screen printing. The squeegee holder module 31 then rests on the screen holder module 29 by way of the end stop D' making contact on the end stop D as illustrated in FIG. 4. The squeegee holder module 31 thus rests indirectly on the chassis 27 via the screen holder module 29.

The actuator 99 controls the position of the carriage 97 and the positions of the squeegee 103 and the counter squeegee 105 along the direction of printing Ox. The pneumatic actuators 107 make it possible to bring the squeegee 103 and the counter squeegee 105 respectively in contact with the screen 65 along the direction Oz.

In order to move the print head 7 from the operating position to the maintenance position, the motor 129 of the actuator 131 unscrews the shaft 8 in the ball nut 135, which lowers the first part 125, and the second part 127 being supported on the chassis 27 via the print head 7. The end stop B' then comes into contact with the end stop B. The print head 7 is then in the position shown in FIG. 15.

The actuator 8 operates in a first mode of operation, wherein the first part 125 is supported on the chassis 27 and the second part 127 moves the print head 7 relative to the chassis 27. The movement of the unscrewing of the shaft 131 being continued and the first part 125 being supported on the chassis 27 by the end stop B' in contact with the end stop B, the second part 127 raises the print head 7 relative to the chassis 27.

At the beginning of this movement, the screen holder module 29 being fastened on to the chassis 27, only the squeegee holder module 31 rises. The head 81 of the indexing member 77 (FIG. 10) descends into the housing 113 of the complementary indexing member 111 (FIG. 13). The end stop D' moves away from the end stop D. the end stop C' comes into contact with the end stop C. The squeegee holder module 31 rises from the height H of 30 mm, for example, and passes from the relative position of use to the position of differential lifting. The print head 7 passes from the position as illustrated in FIG. 15 to that illustrated in FIG. 16.

The fastening system 37 then releases the screen holder module 29 which continues to be held relative to the chassis 27 by the cooperation between the indexing member 77 and the complementary indexing member 111.

The movement of unscrewing of the shaft 131 is continued, with the screen holder module 29 and the squeegee holder module 31 climbing together up to the maintenance position of the print head 7 as shown in FIGS. 3 and 17. It is then possible to perform a maintenance operation on the screen 65 or the squeegee 103, the print head 7 being away from the object holder module 5. In addition, the squeegee holder module 31 is advantageously placed automatically in the position of differential lifting.

In order to replace the print head 7 in the operating position, the operations that are the reverse of those described here above are carried out.

The motor 129 screws the shaft 131 into the ball nut 135. The print head 7 descends relative to the chassis 27. The screen holder module 29 is locked into its initial position as in FIG. 15. The squeegee holder module 31 continues its descent and passes from the position of differential lifting to the relative position of use, with the end stops D and D' being in contact.

In an alternative manner, the screen holder module 29 is not locked into its initial position as in FIG. 15, but in another position. This advantageously allows for the moving of the print head 7 from the operating position shown in FIG. 15 to another operating position that is higher or lower relative to the chassis 27.

When the device 1 prints an impression on the object 3, the print head 7 is, as described here above, in the operating position (FIGS. 1, 2 and 4).

Prior to printing of the impression on the object 3, the turn table goes on to place the object holder module 5 under the print head 7. Under the print head 7, the object holder module moves substantially tangentially to the direction of printing Ox.

The roller 27 (FIG. 2) is then engaged in the cam channel 59 of the movable carriage 35. Because of this the carriage 11 of the object holder module 5 and the carriage 35 are thus integrally secured in elevation relative to the chassis 27. The carriage 35 is also integrally secured in elevation with the first part 125 of the actuator 8. Thus, the position of the first part 125 relative to the chassis 27 determines the elevation of the object holder module 5 when the end stops B and B' are no longer in contact.

The tilt of the arm 13 and the object about 3 the axis 15 is adjusted by using the means 17, 19. The actuator 25 controls the position of the object 3 rotating about the axis 23 during printing.

The actuator 8 then operates in a second mode of operation. The second part of the actuator 127 is supported on the chassis 27 by means of the squeegee holder module 31 and the screen holder module 29.

By the screwing, and respectively the unscrewing of the shaft 131 in the ball nut 135, the first part 125 is raised, respectively lowered relative to the chassis 27. Thus the actuator 8 changes the elevation of the object holder module 5 relative to the chassis 27.

The force sensor 137 provides information with respect to the configuration in which the device 1 is to be found. If the force measured by the sensor 137 is substantially nil, the actuator 8 is in the second mode of operation, wherein there is no contact between the end stops B and B'. If the force measured by the sensor 137 is not substantially nil, for example greater than a threshold value, then the actuator 8 is in the first mode of operation. If the force measured by the sensor 137 is substantially equal to the weight of the actuator 8, of the carriage 35 and the print head, it is due to the actuator 8 holding the print head 7. It is also possible to detect the configurations in which the actuator 8 holds only the squeegee holder module 31. A force greater than the weight of the actuator 8, of the carriage 35 and the print head 7 indicates for example, the locking of the fastening system 37.

Owing to the characteristic features described here above, in particular the first mode of operation and the second operation mode of the actuator 8, it is possible, with a single actuator 8, to move the print head 7 from the operating position to the maintenance position, and to modify the elevation of the object holder module 5 relative to the chassis 27. This simplifies the printing device 1 and reduces its cost, while at the same time retaining the functionalities comparable to a printing device having two actuators.

Moreover, thanks to the optional characteristic feature according to which the fastening system 37 is adjustable in elevation, the device 1 has the added advantage of having a plurality of operating positions for use of the print head 7, the actuator 8 being capable of moving the print head 7 from one to another of the operating positions.

Finally, thanks to the optional characteristic feature according to which the screen holder module 29 includes the indexing member 77 and the squeegee holder module 31 includes the complementary indexing member 111 that cooperates with the indexing member 77, the actuator 8 is also capable of moving the squeegee holder module 31 from the relative position of use to the position of differential lifting.

The invention claimed is:

1. A device for printing an impression by silk screen printing on at least one object, comprising:

a chassis;

an object holder module that is designed to hold the object, the object holder module being movable relative to the chassis along a direction of pressing;

a print head including a screen holder module that is designed to hold a screen and a squeegee holder module that is designed to hold a squeegee located facing the screen, the print head being movable relative to the chassis between an operating position close to the object holder module, and a maintenance position away from the object holder module; and an actuator having a first part and a second part that is movable relative to the first part, the actuator being adapted, in a first mode of operation, to be supported on the chassis by its first part and capable of moving the print head from the operating position to the maintenance position by a movement of the second part, wherein the actuator is adapted, in a second mode of operation, to be supported on the chassis by the second part and is capable of moving the object holder module along the direction of pressing relative to the chassis by a movement of the first part.

2. A device according to claim 1, wherein in the first mode of operation, the first part of the actuator is supported on an end stop of the chassis.

3. A device according to claim 1, further comprising a fastening system designed, selectively, for fastening the screen holder module on to the chassis in a manner such that the print head forms a support for the second part of the actuator, and for releasing the screen holder module so as to enable said movement of the print head from the operating position to the maintenance position.

4. A device according to claim 3, wherein the fastening system is adjustable along the direction of pressing for selectively fastening the screen holder module on to the chassis in a plurality of positions along the direction of pressing defining a plurality of operating positions for use of the print head, the actuator being capable, in the first mode of operation, of moving the print head from any one of the operating positions from among said plurality of operating positions to any other operating position from among said plurality of positions when the screen holder module is released relative to the chassis.

5. A device according to claim 3, wherein the fastening system comprises a rack fastened on to one of either the screen holder module and the chassis, and a latch fastened on to the other of the screen holder module and the chassis, the latch being movable selectively between a closed position wherein the latch engages on to the rack so as to lock in the screen holder module relative to the chassis along the direction of pressing and an open position for releasing the screen holder module.

6. A device according to claim 1, wherein:

the screen holder module is mounted so as to be movable relative to the squeegee holder module along the direction of pressing, and the screen holder module comprises an indexing member and the squeegee holder module comprises a complementary indexing member, the indexing member of the screen holder module being capable of cooperating with the complementary indexing member in order to define a relative position of use of the squeegee holder module relative to the screen holder module intended to enable contact between the squeegee and the screen, and wherein the indexing member forms a bottom end stop for the complementary indexing member, and a position for differential lifting of the squeegee holder module relative to the screen holder module designed to move the squeegee away from the screen, and wherein the complementary indexing member forms a bottom end stop for the indexing member.

7. A device according to claim 6, wherein the indexing member comprises a base, a rod extending along the direction of pressing, and a head that is wider than the rod, and in that the complementary indexing member defines a housing extending along the direction of pressing and adapted to receive the head, the housing having a narrowed opening around the rod so as to trap the head, the head being adapted to abut against the opening of the housing and the opening of the housing being adapted to abut against the base.

8. A device according to claim 6, wherein the indexing member and the complementary indexing member are suitably dimensioned such that in the position of differential lifting, in relation to the relative position of use, the squeegee holder module is positioned at a distance from the screen holder module at a height of between 15 mm and 60 mm, preferably equal to about 30 mm.

9. A device according to claim 1, wherein the actuator comprises a threaded shaft, a ball nut mounted so as to be movable only in translational motion on the shaft, and a motor for driving the shaft in axial rotation.

10. A device according to claim 9, wherein the ball nut is located in the first part of the actuator and the motor is located in the second part.

11. A device according to claim 1, further comprising a pressure sensor adapted to be compressed between the chassis and the first part of the actuator in order to measure the forces transmitted to the chassis by the first part of the actuator.

* * * * *